US007066348B2

(12) United States Patent
Skavnak

(10) Patent No.: US 7,066,348 B2
(45) Date of Patent: Jun. 27, 2006

(54) VENDING MACHINE WITH HORIZONTAL PRODUCT PRESENTATION

(75) Inventor: James E. Skavnak, Minneapolis, MN (US)

(73) Assignee: Gross-Given Manufacturing Company, St. Paul, MN (US)

( * ) Notice: Subject to any disclaimer, the term of this patent is extended or adjusted under 35 U.S.C. 154(b) by 0 days.

(21) Appl. No.: 10/693,799

(22) Filed: Oct. 24, 2003

(65) Prior Publication Data

US 2005/0087544 A1 Apr. 28, 2005

(51) Int. Cl.
*G07F 11/00* (2006.01)

(52) U.S. Cl. ..... 221/75

(58) Field of Classification Search ..... 221/75
See application file for complete search history.

(56) References Cited

U.S. PATENT DOCUMENTS

| | | | | |
|---|---|---|---|---|
| 3,178,055 | A | 4/1965 | Schuller | |
| 3,269,595 | A * | 8/1966 | Krakauer et al. | 221/75 |
| 3,344,953 | A | 10/1967 | Krakauer et al. | |
| 3,591,045 | A * | 7/1971 | Sturrock | 221/75 |
| 3,653,540 | A * | 4/1972 | Offutt | 221/75 |
| 3,883,039 | A * | 5/1975 | Wittern et al. | 221/75 |
| 3,941,279 | A | 3/1976 | Krakauer | |
| 3,993,215 | A * | 11/1976 | Cox et al. | 221/75 |
| 4,677,777 | A | 7/1987 | Hoffman et al. | |
| 4,757,915 | A * | 7/1988 | Albright et al. | 221/75 |
| 5,303,844 | A * | 4/1994 | Muehlberger | 221/1 |
| 5,307,941 | A * | 5/1994 | Siegal | 211/11 |
| 5,407,264 | A | 4/1995 | Giegerich et al. | |
| 5,439,134 | A * | 8/1995 | Tsuda et al. | 221/75 |
| 5,511,646 | A | 4/1996 | Maldanis et al. | |
| 5,842,355 | A | 12/1998 | Kalis et al. | |
| 5,884,745 | A | 3/1999 | Kalis et al. | |
| 6,279,718 | B1 | 8/2001 | Nulph et al. | |

FOREIGN PATENT DOCUMENTS

| | | |
|---|---|---|
| DE | 3615110 | 11/1986 |
| EP | 0258668 | 8/1987 |
| GB | 2175118 | 11/1986 |

* cited by examiner

*Primary Examiner*—David H. Bollinger
(74) *Attorney, Agent, or Firm*—Gerald E. Helget; Nelson R. Capes; Briggs and Morgan, P.A.

(57) ABSTRACT

A vending machine with a cabinet for articles having a long dimension and a short dimension. A multiplicity of shelves are supported in cabinet. Helical feeder coils rest within slots on each shelf. Each helical feeder coil is adapted to receive articles in its convolutions with the articles slidably supported by the shelf along the long dimension. The articles are separated, but unsupported, by the helical feeder coil. Motors, rotatably drive the helical feeder coils for moving the articles to be vended.

20 Claims, 7 Drawing Sheets

VENDING MACHINE WITH HORIZONTAL PRODUCT PRESENTATION

BACKGROUND OF THE INVENTION

This invention relates generally to vending machines and more particularly to an improved vending apparatus adapted to deliver selected packaged articles upon the actuation of one of a plurality of helical feeder coils overlying a supporting surface upon which packaged articles are disposed. The helical feeder coils rest in slots on the supporting surface such that part of the coil is above and part of the coil is below the supporting surface, so that the articles rest directly on the supporting surface without any support from the helical feeder coil.

In most earlier machines of this type, the articles rest within the convolutions of the feeder coils so that the long dimension of the articles is perpendicular to the convolutions of the coil, i.e., the articles are generally disposed vertically. This requires feeder coils with convolutions that are substantially larger than necessary to hold the articles. Furthermore, the articles are not held firmly within the feeder coil, but can move about, which can cause feeder jams. Finally, this arrangement takes up unnecessary vertical space within the vending machine, limiting its article holding capacity.

Coin-controlled vending machines incorporating drivable members for separating, retaining, advancing and discharging articles held horizontally are shown in the U.S. patents to Krakauer et al, U.S. Pat. No. 3,269,595, issued Aug. 30, 1966, U.S. Pat. No. 3,344,953, issued Oct. 3, 1967, and U.S. Pat. No. 3,941,279, issued Mar. 2, 1976 (see prior art FIG. 1).

Several disadvantages are inherent in such machines as above described. In the two earlier patents, the articles are not supported directly on the shelf, but rather on a longitudinal bar that resides within the convolutions of the feeder coil. This horizontal bar adds unnecessary complexity to the apparatus and, in addition, may cause the feeder coil to jam if the length of the feeder coil and bar is excessive. The third patent shows articles resting directly on the shelf, but not between the convolutions of the feeder coil. Instead, the articles are moved along the shelf by a pair of arms that extend outward from the feeder coil and traverse most of the compartment in which the article rests. This adds unnecessary complexity and, in addition, prevents adjacent feeder coils from being disposed close to one another, which in turn limits the article holding capacity of the shelf. These prior art machines also waste significant vertical space about the articles to be vended as shown in FIG. 1.

There is a need for an improved vending machine that simplifies the structure of the feeder coil and shelf while providing increased article holding capacity.

SUMMARY OF THE INVENTION

A vending machine with a cabinet for articles having a long dimension and a short dimension. A multiplicity of shelves are supported in cabinet. Helical feeder coils rest within slots on each shelf. Each helical feeder coil is adapted to receive articles in its convolutions with the articles slidably supported by the shelf along the articles' long dimension. The articles are separated, but unsupported, by the helical feeder coil. Motors rotatably drive the helical feeder coils for moving the articles to be vended.

DETAILED SPECIFICATION

Figure 1:
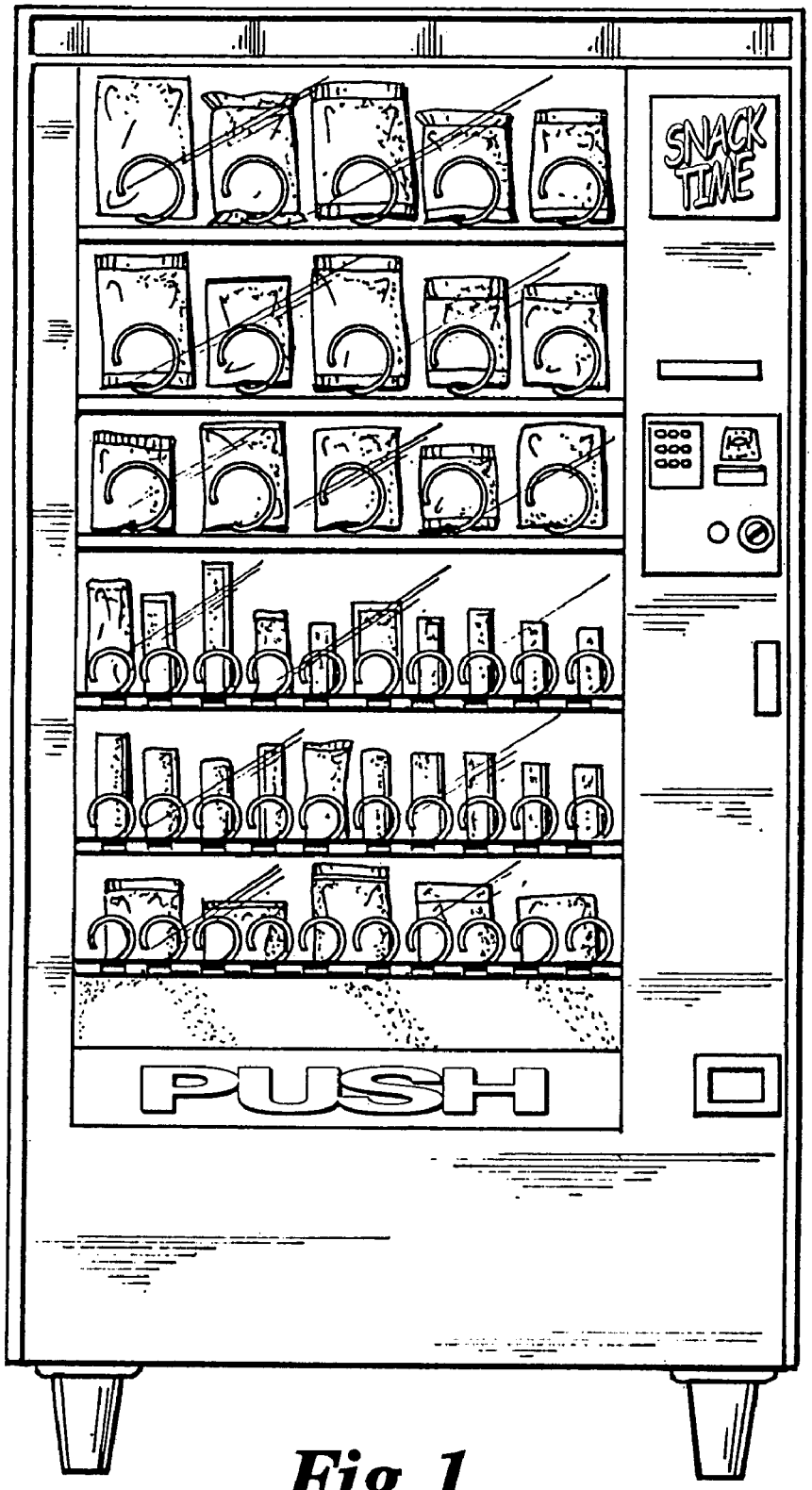
Fig. 1. PRIOR ART
FIG. 1 is a front elevational view of a vending machine of the prior art.
Figure 2A:
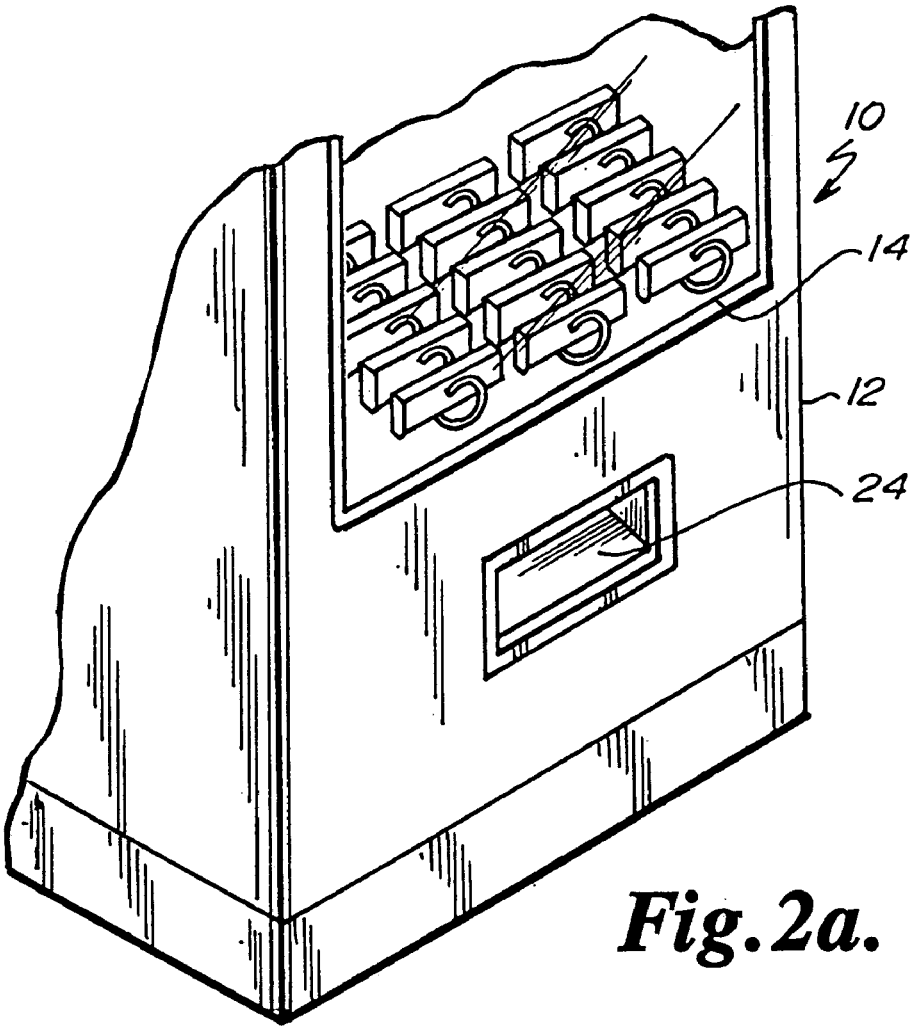
FIG. 2*a* is a front perspective view of a vending machine of the present invention broken away.
Figure 2B:
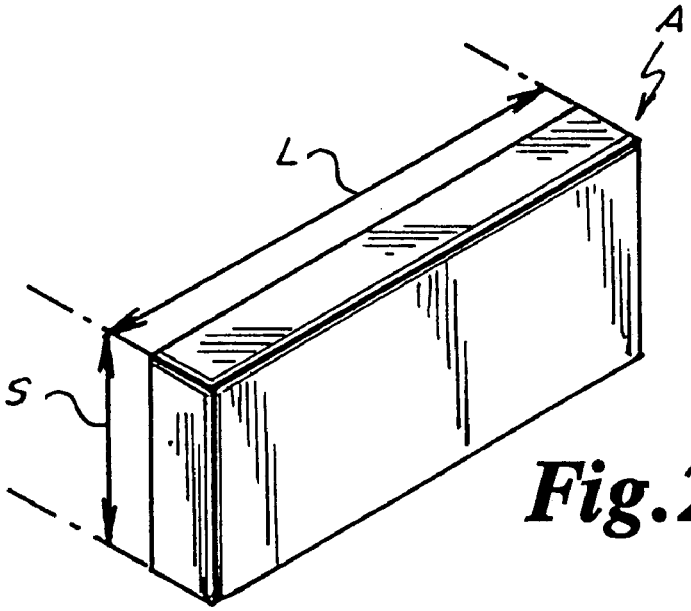
FIG. 2*b* is a front perspective view of an article to be vended by the present invention.

Referring to FIGS. 2 through 7, the present invention maybe appreciated. The vending machine 10 generally comprises a cabinet 12 with a multiplicity of low profiles shelves 14 supported within the cabinet 12. Each shelf 14 has a front end 16 a back end 18*a*, top surface 20 and a bottom surface 22. The vending machine further includes a discharged opening 24 shown in FIG. 2*a* from which articles A, shown in FIG. 2*b*, are dispensed. Articles A are generally described as each having a short dimension S and a long dimension L which will be appreciated herein.

Referring to FIGS. 2 through 7, the present invention may be appreciated. The vending machine 10 generally comprises a cabinet 12 with a multiplicity of low profile shelves 14 supported within the cabinet 12. Each shelf 14 has a front end 16 a back end 18*a,* top surface 20 and a bottom surface 22. The vending machine further includes a discharge opening 24 shown in FIG. 2*a* from which articles A, shown in FIG. 2*b,* are dispensed.

Figure 4:
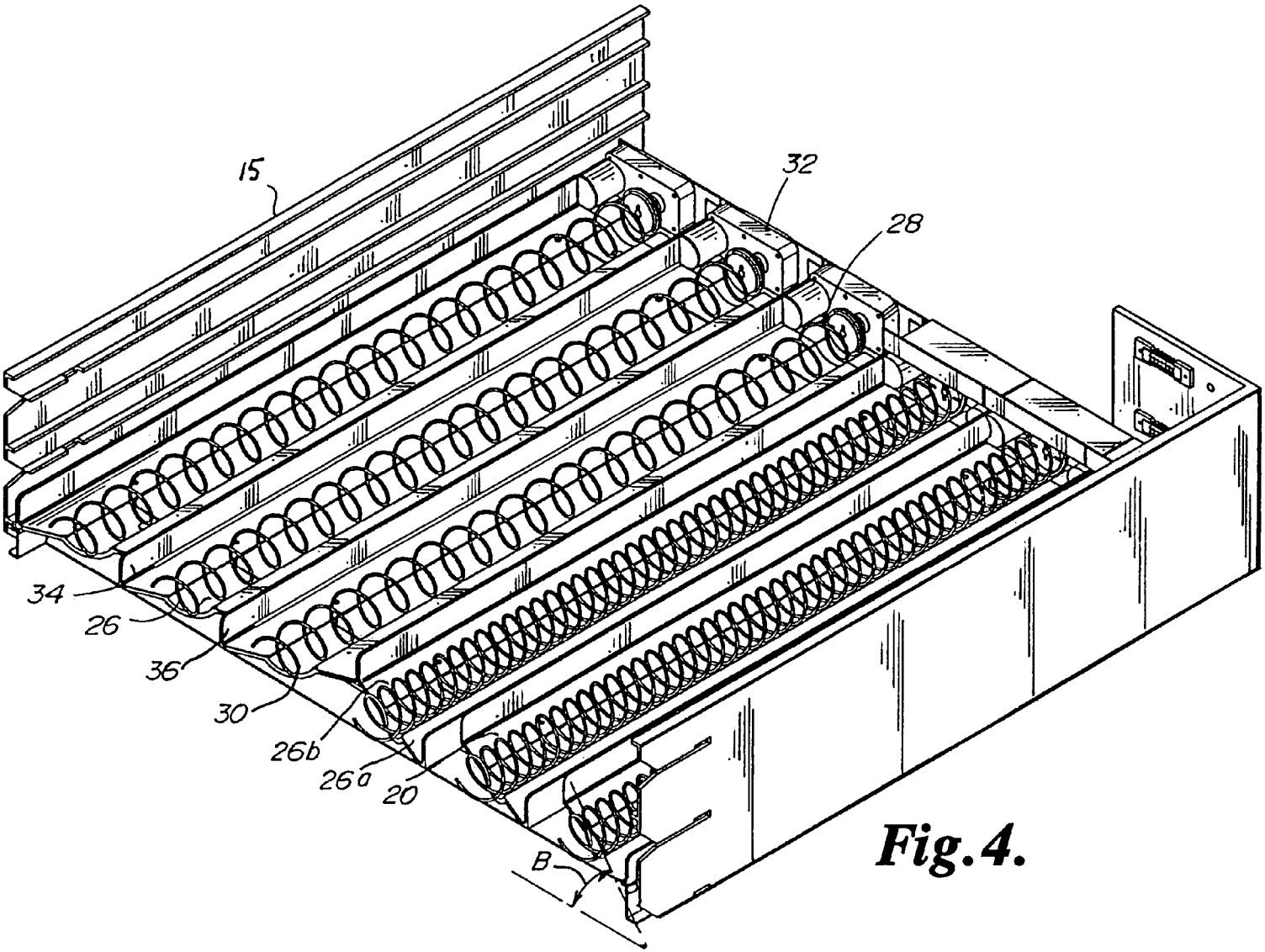
FIG. 4 is similar to FIG. 3, but with the articles removed to show the structure of the shelf.

FIG. 4 shows that cabinet brackets 15 may be mounted within the cabinet 12 as well-known by those skilled in the art. Each pair of brackets 15 will support three shelves 14 in a compact fashion as opposed to a single shelf that is known as in the prior art. Dividing up shelf 14 are pairs of guide rails 34 and 36, one pair for each slot 26. The top surface 20 of the shelves are divided into article A compartments by guide rails 34 and 36 while helical feeder coils 28 glide in slots 26, partially depending below. Articles A rest on their long dimension L presenting to the consumer their front surface with advertising. Articles A are supported by the top surface 20 of the shelves 14 and are kept in position by guide rails 34 and 36 and are further moved along for vending by helical feeder coils 28.

Figure 3:
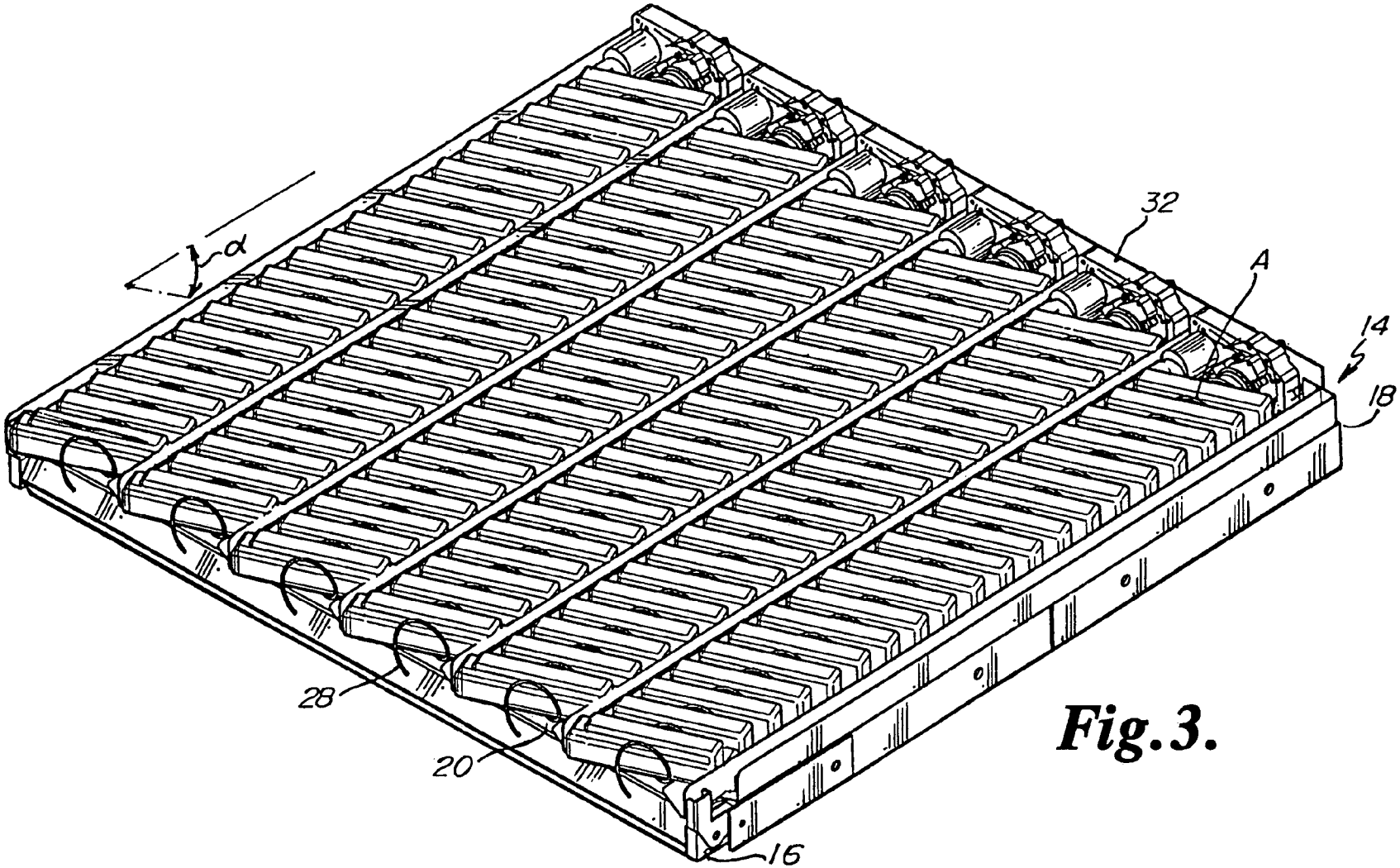
FIG. 3 is a front perspective view of a vending machine shelf of the present invention with articles resting thereon.

The helical feeder coils 28 are adapted to receive articles A between adjacent convolutions 30 at an acute angle $\alpha$ to the slots 26 as shown in FIG. 3. The angle $\alpha$ is determined by the pitch of the helical feeder coil 28 in the slot 26. To support this offset presentation of articles A, one side 26*a* of shelf 14 adjacent 26 is longer than the other side 26*b*. Thus, the shelves 14 deliver articles A at an acute angle $\beta$ to the slots 26 as is shown in FIG. 4. Preferably the vending machine comprises six slots 26 with six helical feeder coils 18 and motors 32 for driving each coil 18. As may be appreciated in FIG. 3, all feeder coils 18 rotate in the same direction, as they equally present articles A to be vended.

Figure 5:
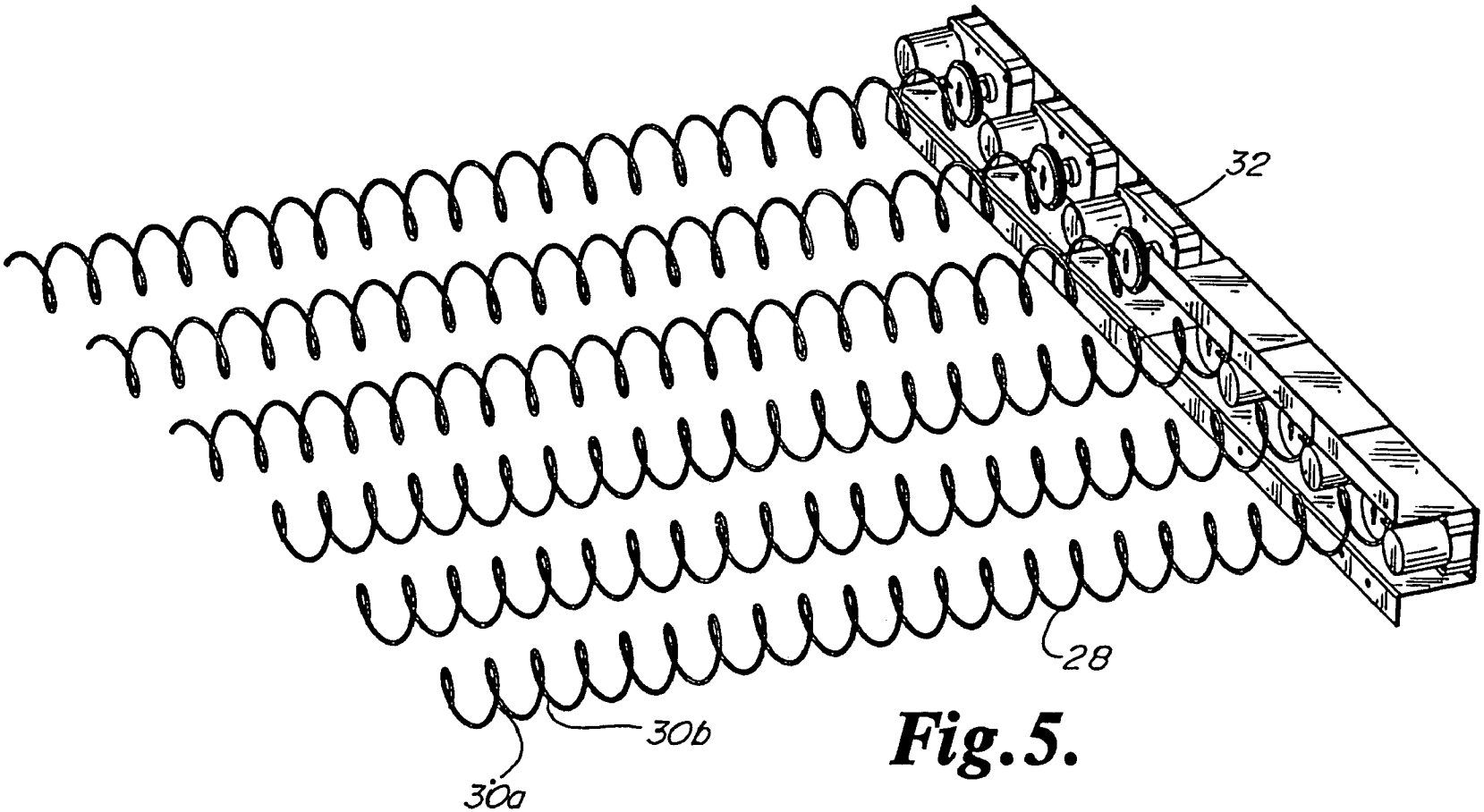
FIG. 5 is a front perspective view of the helical feeder coils and motors of the present invention.
Figure 6:
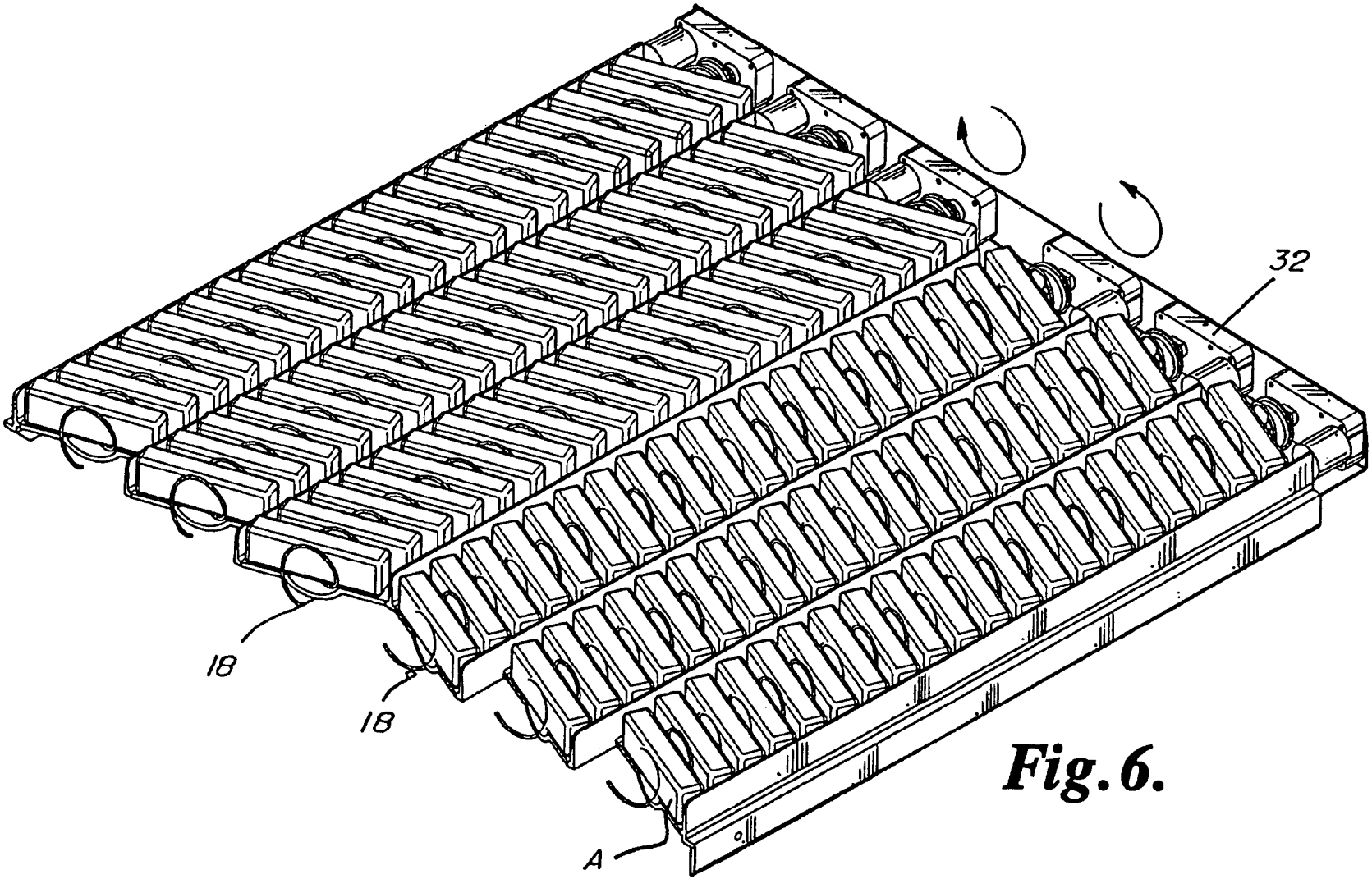
FIG. 6 is similar to FIG. 3, showing one embodiment of a vending machine shelf of the present invention, wherein the opposing feeder coils rotate in opposite directions.

Referring to FIGS. 4–6, it may generally be appreciated that each shelf 14 may be divided in half with one half of the feeder coils 18 rotating in a clockwise rotation and the other remaining helical feeder coils 18 rotating in counter clockwise rotation as shown in FIG. 6. By this arrangement the presentation of articles A is generally directed towards the center line of the cabinet 12 of vending machine 10.

The vending machine 10 has increased capacity. It may be appreciated in both FIGS. 3 and 6, by either rotating arrangement, each shelf will generally hold approximate one hundred twenty articles A to be vended in an extremely low profile design. Upon placement of three shelves 14 into brackets 15 of FIG. 4, the space which normally holds one shelf with one hundred eighty articles A, will now double its capacity to three hundred sixty articles A.

Figure 7A:
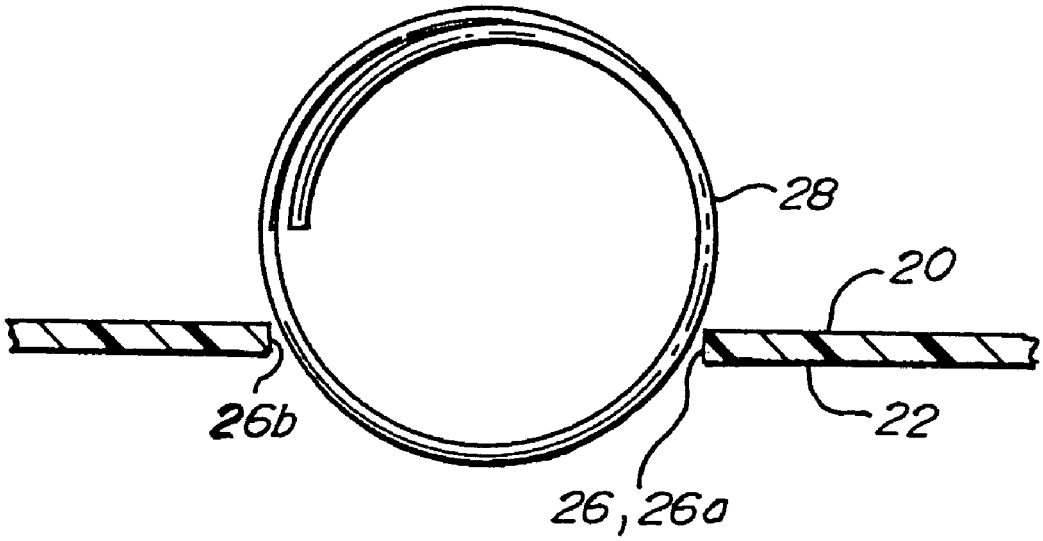
FIG. 7*a* is a front elevational view of one embodiment of a vending machine shelf of the present invention, wherein part of the feeder coil convolutions project below the slot.
Figure 7B:
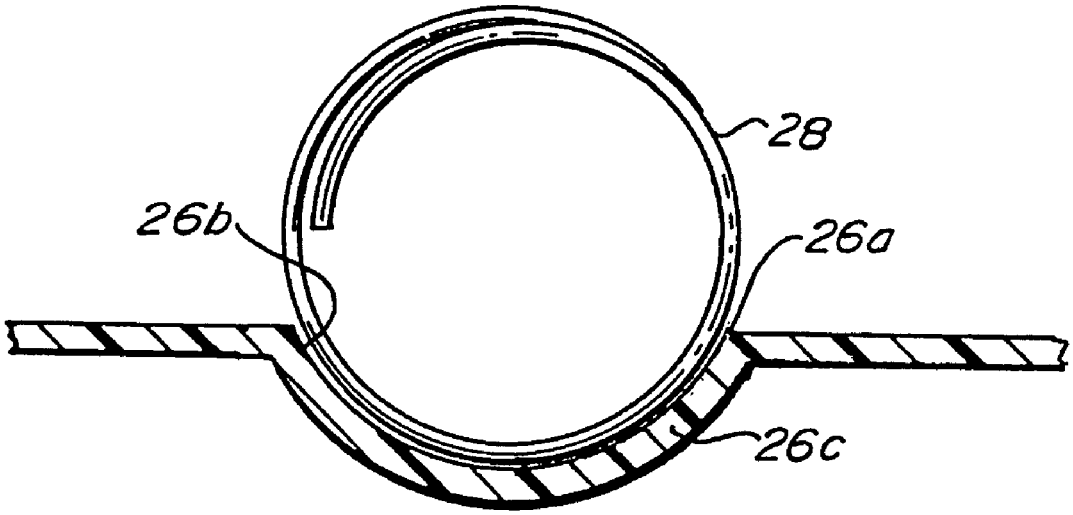
FIG. 7*b* is a front elevational view of a second embodiment of a vending machine shelf of the present invention, wherein the feeder coil convolutions rest on a curved support structure.

Referring to FIGS. 4, 7*a* and 7*b*, alternative shelf 14 constructions may be appreciated. FIG. 7*a* shows slots 26 in shelf 14 to permit feeder coils 28 to nest into slots 26 wherein the edges 26*a* and 26*b* support the coils 28. This arrangement is shown in the right side of FIG. 4 with the three smaller feeder coils 28. An alternative to having a slot 26 through the shelf 14 will be the curved support 26*c* as shown in FIG. 7*b*. This arrangement is shown on the left side of FIG. 4 with the larger feeder coils 28. The benefit to this design will allow a smaller coil 28 to be driven in the slot 26*c* that otherwise would fall through the slot 26 between edges 26*a* and 26*b*.

In operation, new shelf brackets 15 are mounted within cabinet 12 of the vending machine 10. The shelves 14 are mounted between brackets in a slidable arrangement. The shelves 14 may be moved out for loading of articles A into the machine 10. As a consumer places money into the vending machine 10, a selected motor 32 is operated to advance a helical feeder coil 28 to present an article A forwardly to drop off of the top surface 20 of shelf 14, due to either edge 26*a* or 26*b* being shorter than the other, and to permit the article to be dispensed out of discharge opening 24. While this machine 10 uniquely provides the front surface of article A for easy recognition by the consumer, the present invention also doubles the capacity of the vending machine 10 compared to other prior art vending machines. This is simply because there is no waste in vertically space, as is no well known in the prior art, as in FIG. 1.

The present invention may be embodied in other specific forms without departing from the spirit or the essential attributes thereof, and it is therefore desired that the present embodiment be considered in all effects as illustrative and not restricted, reference being made to the appendent claim rather than the forgoing description indicate the scope of the invention.

What is claimed:

1. A vending machine for articles, the articles having a long dimension and a short dimension, the vending machine comprising:

(a) a cabinet;

(b) a low profile shelf supported in the cabinet, the shelf having a front end and an back end, a top surface and a bottom surface;

(c) a discharge opening below the front end of the shelf;

(d) at least two slots in the shelf between the front end and the back end and extending through the shelf from the top surface to the bottom surface, the slots having two sides;

(e) a helical feeder coil resting in each of the at least two slots, the helical feeder coil being adapted to receive articles in its convolutions, with the articles slidably supported by the shelf along the long dimension; and (f) a motor rotatably driving each of the helical feeder coils; and (g) wherein one of the helical feeder coils rotates clockwise and another helical feeder coil rotates counterclockwise.

2. The vending machine of claim 1, wherein each helical feeder coil is adapted to receive each article between adjacent convolutions at an acute angle to the slot, the angle being determined by the pitch of the helical feeder coil.

3. The vending machine of claim 1, wherein one side of each slot is longer than the other side, the slot thus delivering articles at an acute angle to the discharge opening.

4. The vending machine of claim 1, wherein each helical feeder coil has no internal support structure for the articles.

5. The vending machine of claim 1, further comprising a pair of guide rails on each side of each slot, wherein adjacent slots share the same guide rail.

6. The vending machine of claim 1, wherein each helical feeder coil rests in each slot with part of each convolution protruding therethrough from the top surface to the bottom surface.

7. The vending machine of claim 1, wherein each slot further comprises a curved support portion substantially matching the curvature of the convolutions, with the convolutions resting upon the curved support portion.

8. A low profile, improved capacity shelf for holding and delivering articles in a vending machine, the articles having a long dimension and a short dimension, the shelf having a front end and an back end, a top surface and a bottom surface, the shelf comprising:

(a) slots in the shelf between the front end and the back end and extending through the shelf from the top surface to the bottom surface, the slot having two opposing shelf side edges;

(b) helical feeder coils resting in the slots upon the shelf slot edges with part of each convolution protruding therethrough from the top surface to the bottom surface, the helical feeder coils being adapted to receive articles in their convolutions, with the articles slidably supported by the shelf along the long dimension; and (c) motors rotatably driving the helical feeder coils.

9. The vending machine shelf of claim 8, comprising at least six slots, six helical feeder coils, and six motors.

10. The vending machine shelf of claim 9, wherein one of the helical feeder coils rotates clockwise and the other helical feeder coil rotates counterclockwise.

11. The vending machine shelf of claim 8, wherein the helical feeder coils has no internal support structure for the articles.

12. The vending machine shelf of claim 8, further comprising pairs of guide rails on each side of the slots, wherein adjacent slots share the same guide rail.

13. A vending machine for articles, the articles having a long dimension and a short dimension, the vending machine comprising:

(a) a cabinet;

(b) a shelf having a slot with a top surface and a bottom surface, the shelf supported in the cabinet;

(c) a helical feeder coil resting on the shelf, the helical feeder coil being adapted to receive articles in its convolutions, with the articles slidably supported by the shelf along the long dimension and the articles being unsupported by the helical feeder coil wherein the helical feeder coil rests in the slot with part of each convolution protruding therethrough from the top surface to the bottom surface; and (d) a motor rotatably driving the helical feeder coil.

14. The vending machine of claim 13, comprising at least two helical feeder coils and two motors.

15. The vending machine of claim 14, wherein one of the helical feeder coils rotates clockwise and the other helical feeder coil rotates counterclockwise.

16. The vending machine of claim 14, further comprising a pair of guide rails on each side of the helical feeder coils, wherein adjacent helical feeder coils share the same guide rail.

17. The vending machine of claim 13, wherein the slot further comprises a curved support portion substantially matching the curvature of the convolutions, with the convolutions resting upon the curved support portion.

18. A shelf for holding and delivering articles in a vending machine, the articles having a long dimension and a short dimension, the shelf having a slot with a top surface and a bottom surface and comprising:

(a) a helical feeder coil resting on the shelf, the helical feeder coil being adapted to receive articles in its convolutions, with the articles slidably supported by the shelf along the long dimension and the articles being unsupported but movable by the helical feeder coil comprising at least two helical feeder coils and two motors, wherein one of the helical feeder coils rotates clockwise and the other helical feeder coil rotates counterclockwise; and (b) two motors rotatably driving the helical feeder coils.

(c) further comprising a pair of guide rails on each side of the helical feeder coils, wherein adjacent helical feeder coils share the same guide rail.

19. The vending machine of claim 18, wherein the helical feeder coil rests in the slot with part of each convolution protruding therethrough from the top surface to the bottom surface.

20. The vending machine of claim 18, wherein the slot further comprises a curved support portion substantially matching the curvature of the convolutions, with the convolutions resting upon the curved support portion.

* * * * *